US005402220A

United States Patent [19]

Tanaka et al.

[11] Patent Number: 5,402,220

[45] Date of Patent: Mar. 28, 1995

[54] FIXING DEVICE FOR AN IMAGE FORMING APPARATUS FEATURING A FIXING BELT AND HEATING CONTROL

[75] Inventors: Mitsuo Tanaka; Tsuneo Kurotori, both of Tokyo; Takashi Bisaiji, Yokohama; Takeshi Takemoto, Yamato; Kohichiro Jinnai, Kawasaki; Toshio Kawakubo, Yokohama, all of Japan

[73] Assignee: Ricoh Company, Ltd., Tokyo, Japan

[21] Appl. No.: 111,007

[22] Filed: Aug. 24, 1993

[30] Foreign Application Priority Data

| | | | |
|---|---|---|---|
| Aug. 25, 1992 | [JP] | Japan | 4-225623 |
| Sep. 11, 1992 | [JP] | Japan | 4-242833 |
| May 11, 1993 | [JP] | Japan | 5-108997 |

[51] Int. Cl.[6] ..... G03G 15/20

[52] U.S. Cl. ..... 355/285; 219/216

[58] Field of Search ..... 355/282, 285, 290; 219/216; 432/60

[56] References Cited

U.S. PATENT DOCUMENTS

| | | | |
|---|---|---|---|
| 4,434,353 | 2/1984 | Marsh et al. | 219/216 |
| 4,801,968 | 1/1989 | Kogure et al. | 219/216 X |
| 4,883,941 | 11/1989 | Martin et al. | 219/216 |
| 4,922,304 | 5/1990 | Gilbert et al. | 355/282 |
| 5,151,719 | 9/1992 | Akutsu et al. | 355/285 X |
| 5,241,159 | 8/1993 | Chatteriee et al. | 219/216 X |

FOREIGN PATENT DOCUMENTS

| | | | |
|---|---|---|---|
| 0373654 | 6/1990 | European Pat. Off. . | |
| 0426072 | 5/1991 | European Pat. Off. . | |
| 4213236 | 11/1992 | Germany . | |
| 60-22164 | 1/1985 | Japan | 355/285 |
| 62-287277 | 12/1987 | Japan | 355/285 |
| 1-38775 | 2/1989 | Japan | 355/285 |
| 2-221984 | 9/1990 | Japan | 355/285 |
| 5-27627 | 2/1993 | Japan | 355/285 |

OTHER PUBLICATIONS

Patent Abstracts of Japan, vol. 8, No. 14, (P-249) (1451), Jan. 21, 1984, JP-A-58 172 670, Oct. 11, 1983.

Patent Abstracts of Japan, vol. 12, No. 88, (P-678) (2935), Mar. 23, 1988, JP-A-62 222 281, Sep. 30, 1987.

European Search Report.

*Primary Examiner*—William J. Royer

*Attorney, Agent, or Firm*—Oblon, Spivak, McClelland, Maier & Neustadt

[57] ABSTRACT

A fixing device for an image forming apparatus and having a heating member facing a sheet transport path. The heating member has a number of heating portions which are separate in a direction perpendicular to an intended direction of sheet transport. The heating portions are selectively driven in matching relation to a toner image carried on a sheet.

14 Claims, 4 Drawing Sheets

FIXING DEVICE FOR AN IMAGE FORMING APPARATUS FEATURING A FIXING BELT AND HEATING CONTROL

BACKGROUND OF THE INVENTION

The present invention relates to a fixing device applicable to an electronic or a silver halide sensitive type of image forming apparatus.

Fixing systems available in the image forming art may generally be classified into three types, i.e., a heat type system, a pressure type system, and a solvent type system. Among them, the heat type fixing system is practicable with an electrophotographic image forming apparatus. A fixing device implemented with the heat scheme has a heat roller and a press roller facing each other via a sheet transport path and each being rotatably mounted on a respective shaft. The heat roller and press roller are pressed against each other by a spring or similar biasing means. The heat roller melts a toner transferred to a sheet by heating it, while pressing the sheet in cooperation with the press roller during transport. This kind of fixing device is small in size and light in weight since the heat roller heats the sheet and transports it at the same time.

It has been customary with the above-described type of fixing device to configure the heat roller as a hollow cylindrical metallic roller, and a heating resistor body axially extending in the metallic roller. However, the thermal efficiency available with such a heat roller is too low to promote power saving and response. To eliminate this problem, there has been proposed a fixing device having a heat roller whose surface is constituted by a heating resistor, i.e., a surface heat type fixing device. Since this type of fixing device directly causes the surface of the heat roller to generate heat, thermal efficiency is high enough to enhance power saving and response. For example, Japanese Patent Laid-Open Publication No. 164863/1980 teaches a surface heat type fixing device having a rotatable heat roller positioned on a transport path and provided with a plurality of resistors thereon which are separate along the circumference of the roller. In this configuration, only the resistors pressed against a sheet being transported via the surface of the heat roller are driven so as to reduce warm-up time and power consumption.

However, since the conventional surface heat type fixing device heats the entire heat roller, it still needs a long warm-up time and cannot be reduced in size or thickness.

In light of the above, an endless fixing belt and a transport belt may each be passed over a drive roller and a driven roller and be located to face each other via a sheet transport path, as disclosed in, e.g., Japanese Patent Laid-Open Publication Nos. 282576/1991 and 282577/1991. In this configuration, a heating member is positioned to face the sheet transport path via the fixing belt. The fixing belt and transport belt convey a sheet in cooperation while the heating member heats the sheet, thereby fixing a toner image carried on the sheet. This kind of scheme reduces warm-up time and power consumption since only part of the heating member pressed against the sheet via the fixing belt has to generate heat, i.e., it is not necessary for the entire fixing belt or heating member to generate heat. The fixing belt is made up of a heat-resisting layer and a separating layer formed on the heating-resisting layer in order to be resistive to heat and separable from a mold. Specifically, the heat-resisting layer is made of polyimide, polyether ketone, polyether sulfone, polyether imide, polyparabanic acid or similar resin, or nickel, aluminum or similar metal. On the other hand, the separating layer can be formed of polytetrafluoroethyrene or a similar fluoric resin, or silicon resin.

The conventional fixing device, whether it be implemented with a surface heating roller or a fixing belt, heats the entire surface of a sheet, as stated above. This is wasteful in respect of power consumption, since the heating member is wastefully driven despite the fact that a toner image to be heated occupies only a small part of the sheet. Particularly, the fixing device using a fixing belt causes the heating member thereof to heat the sheet by way of the belt, resulting in low thermal efficiency and substantial power consumption. While the thickness, among others, of the fixing belt may be reduced to enhance thermal efficiency, then the durability of the belt will be reduced. Further, although the fixing belt may be implemented by a metallic film having high thermal conductivity, such a belt will sequentially conduct the heat from the heating member along the surface thereof, again resulting in low thermal efficiency.

SUMMARY OF THE INVENTION

It is, therefore, an object of the present invention to provide a fixing device for an image forming apparatus which is capable of reducing power consumption to a sufficient degree.

In accordance with the present invention, a fixing device comprises a heating member provided on a sheet transport path, a pressing member for pressing a sheet being transported along the sheet transport path against the heating member, and heat control means for selectively driving the heating member in matching relation to a toner image carried on the sheet.

Also, in accordance with the present invention, a fixing device comprises an endless fixing belt rotatably supported and constituted by an anisotropic conductive film, a sheet transport path including the periphery of the endless fixing belt for transporting a sheet therealong, and a heating member facing the sheet transport path via the endless fixing belt.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
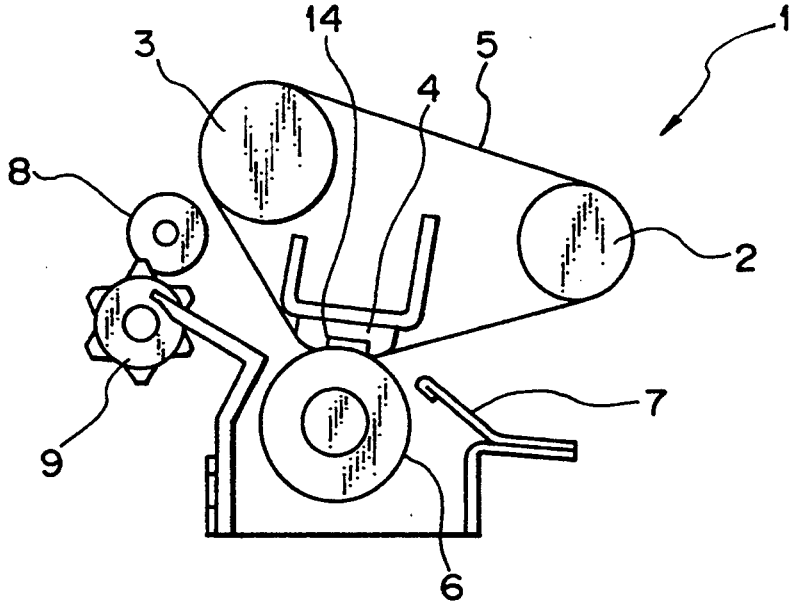
FIG. 1 is a vertically sectioned side elevation of a fixing device embodying the present invention.

Referring to FIG. 1 of the drawings, a fixing device embodying the present invention shown and generally designated by the reference numeral 1. As shown, the fixing device 1 has a drive roller 2, a driven roller 3, a heater unit or heating member 4, and an endless belt 5 passed over the rollers 2 and 3 and heater unit 4. The belt 5 and a transport roller 6 define a sheet transport path therebetween. Also arranged on the transport path are a sheet guide 7, transport rollers 8 and 9, etc.

Figure 2:
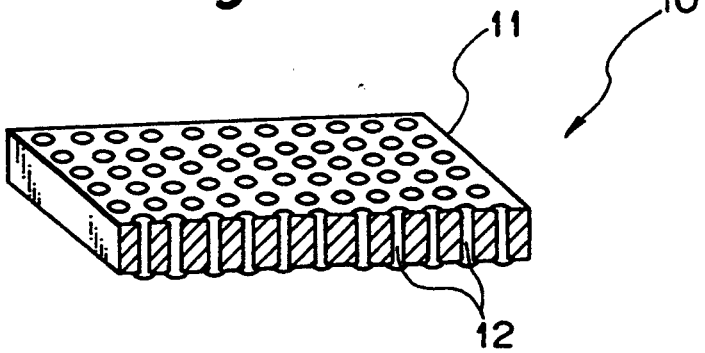
FIG. 2 is a perspective view of an anisotropic conductive film included in the embodiment.
Figure 3:
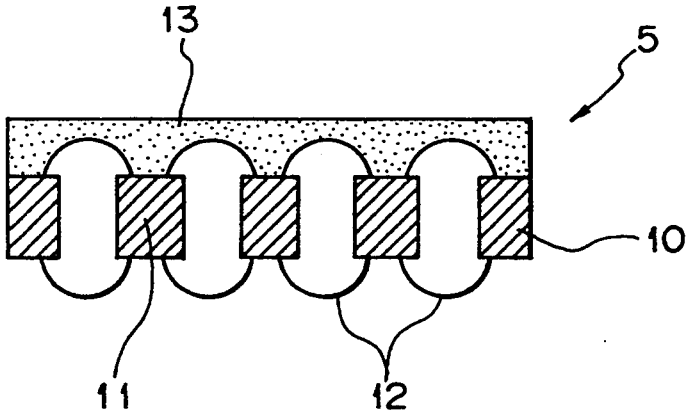
FIG. 3 is a vertically sectioned side elevation of a fixing belt included in the embodiment.

FIG. 2 shows a specific configuration of the belt 5 of the fixing device 1. As shown, the belt 5 is implemented by an anisotropic conductive film 10 made up of a polyimide film 11 and a number of nickel pins 12. The nickel pins 12 are buried in the polyimide film 11 and extend perpendicularly to the general plane of the film 11, as illustrated. More particularly, as shown in FIG. 3, a separating layer 13 of, e.g., PTFE (Poly-Tetrafluoro-Ethylene), fluoric resin or silicone resin is formed on the surface of the anisotropic conductive film 10 by coating, chemical vapor deposition or similar technology. The separating layer 13 is used to promote easy separation of the belt 5 from a mold. In the illustrative embodiment, the film 10 constituting the belt 5 is 5.0 microns to 50 microns thick.

Figure 4:
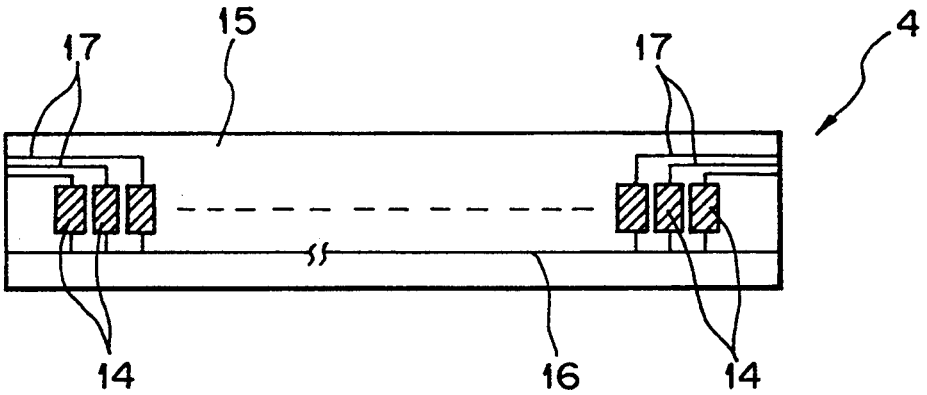
FIG. 4 is a plan view of a heater unit included in the embodiment and playing the role of a heating member.

As shown in FIG. 4, the heater unit 4 has an alumina substrate 15 and a number of heating resistors 14 arranged in a single array on the substrate 15. Specifically, the resistors 14 are provided on the substrate 15 by, e.g., the screen printing of silver palladium or tantalum nitride and serve as an array of heating portions separate in a direction perpendicular to the direction of sheet feed. The resistors 14 are connected to a single common electrode 16 and are each connected to a respective one of a number of independent electrodes 17. The electrode 16 and the electrodes 17 are respectively formed at the front edge and rear edge of the alumina substrate 15 by, e.g., the screen printing of a metallic film. The surface of the substrate 15 where such constituent parts are arranged is entirely covered with a protective layer made of heat-resisting glass.

Figure 5:
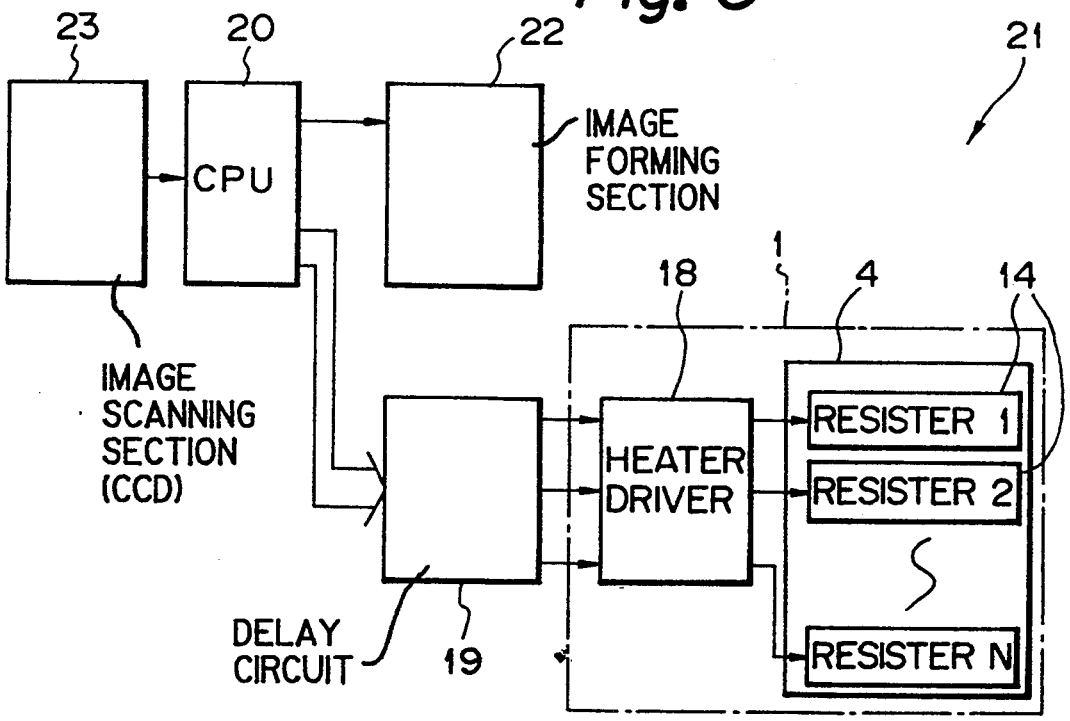
FIG. 5 is a block diagram schematically showing the general arrangement of an image forming apparatus implemented with the embodiment.

Referring to FIG. 5, circuitry representative of an image forming apparatus implemented with the embodiment will be described. As shown, a heater driver 18 is connected to each of the resistors 14 of the heater unit 4 by the electrodes 16 and 17. A CPU (Central Processing Unit) 20 is connected to the heater driver 18 via a delay circuit 19 and plays the role of heat control means. The CPU 20 governs the entire image forming apparatus 21, e.g., a copier. Specifically, the CPU 20 is connected not only to the fixing device 1 but also to an image forming section 22, an image scanning section 23, etc. The image forming section 22 includes an exposing unit and a photoconductive element, while the image scanning section 23 includes a CCD (Charge Coupled Device) array.

In operation, the image scanning section 23 of the copier 21 scans a document, not shown, and generates image data representative of the document. The CPU 20 processes the image data to produce a print signal and a heat signal. The print signal and the heat signal are sent from the CPU 20 to the image forming section 22 and the fixing device 1, respectively. In response to the print signal, the image forming section 22 forms a toner image representative of the document image on a sheet, not shown, and then feeds the sheet to the fixing device 1. In the fixing unit 1, the transport roller 6 and belt 5 cooperate to transport the sheet while the resistors 14 of the heater unit 4 heat the sheet via the belt 5. As a result, the toner image is melted by the heat and fixed on the sheet by the belt 5. At this instant, since the heat signal associated with the image data is sent from the CPU 20 to the fixing device 1 via the delay circuit 19, the fixing device 1 drives the heater unit 4 such that only the resistors 14 located above the toner image generate heat; that is, the other resistors 14 are not driven at all. This is successful in eliminating wasteful heat generation and, therefore, in reducing power consumption.

In the fixing device 1, the resistors 14 of the heater unit 4 heat the sheet being transported by the belt 5, as stated above. Hence, it is not necessary for the belt 5 or the entire heater unit 4 to generate heat, reducing warm-up time and power consumption. In the illustrative embodiment, a number of nickel pins 12 are buried in the anisotropic film 10 and have inherently high thermal conductivity. This provides the film 10 with high thermal conductivity in the direction of thickness and with low thermal conductivity in the direction perpendicular thereto. In this condition, as the heater unit 4 heats the sheet via the belt 5 and in the direction of thickness of the belt 5, heat conduction is promoted. This, coupled with the fact that a minimum of heat radiation occurs in the direction perpendicular to the direction of thickness, insures high thermal efficiency and contributes a great deal to power saving.

In practice, the belt 5 would be lowered flexibility and thermal conductivity if excessively thick or would be lowered in durability if excessively thin. In light of this, the belt 5 should preferably be implemented by the 5.0 microns to 50 microns thick anisotropic conductive film 10 in order to achieve high durability and high flexibility and thermal conductivity at the same time.

Figure 6:
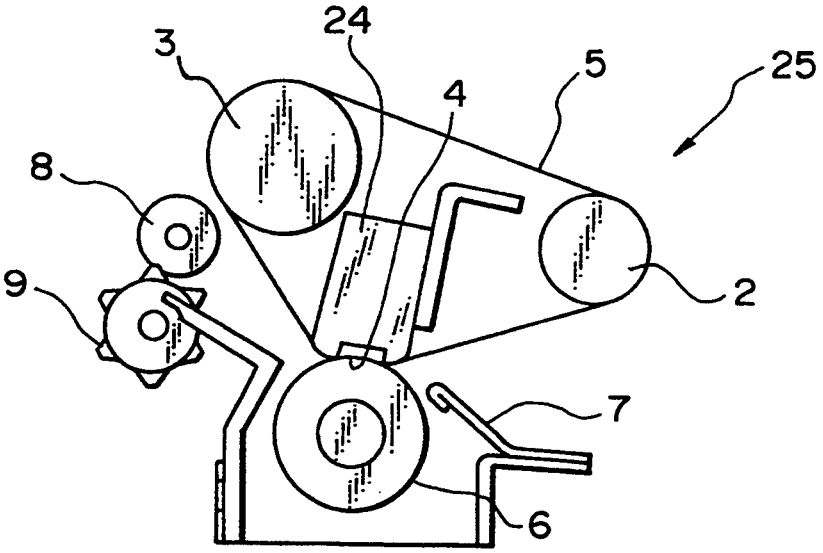
FIG. 6 is a vertically sectioned side elevation of a modification of the embodiment.

In the embodiment, the heater unit 4 is driven such that only the resistors 14 located above the toner image formed on the sheet generate heat. Alternatively, not only such resistors 14 but also the resistors 14 surrounding them may be driven to compensate for an error which may occur in the sheet transport. Further, the resistors 14 may be selectively preheated in matching relation to the image data to eliminate defective fixation. Moreover, the fixing device 1 has been shown and described as comprising the numerous resistors 14 constructed into the exclusive heater unit 4. FIG. 6 shows an alternative fixing device 25 in which the heating member in the form of resistors 14 is replaced with a conventional thermal head 24.

Figure 7A:
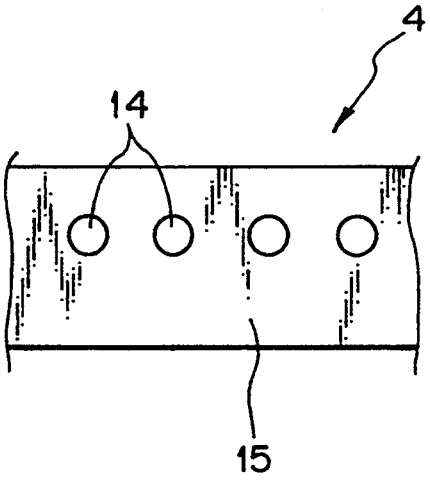
FIGS. 7A and 7B are vertically sectioned side elevations each showing an alternative configuration of the heater unit.
Figure 7B:
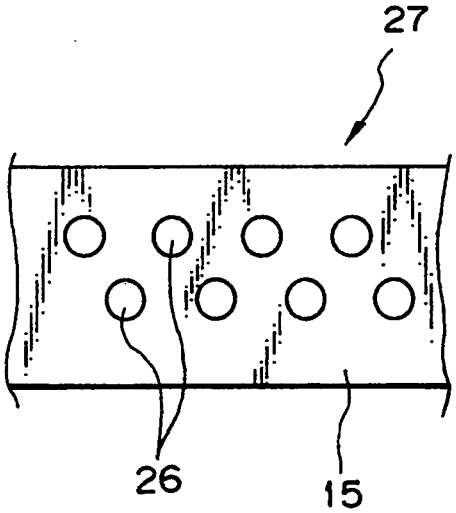

In the illustrative embodiment, the resistors 14 are arranged in a single array in the heater unit 4, as shown in FIGS. 4 and 7A. Alternatively, as shown in FIG. 7B, heating resistors 26 may be arranged in two zigzag arrays to constitute a heater unit 27. The two zigzag arrays also extend in the direction perpendicular to the direction of sheet transport, and each defines particular heating portions. With such a heater unit 27, the fixing device is capable of heating the entire surface of the sheet by the divided resistors 26, thereby eliminating defective fixation.

Figure 8:
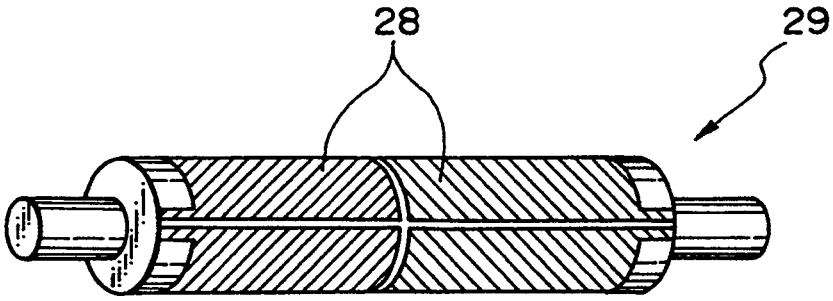
FIG. 8 is a vertically sectioned side elevation of a modified form of a heat roller also serving as a heating member.

Further, in the fixing device 1 or the modification thereof described above, the heating member implemented as the heater unit 4 or 27 is located between opposite runs of the endless rotatable belt 5. Alternatively, as shown in FIG. 8, the heating member may be constituted by a heat generating roller 29 having heating resistors 28 arranged on the surface thereof. The resistors 28 are divided into a plurality of groups in the circumferential direction and the axial direction, so that they may be selectively driven in matching relation to a toner image formed on a sheet. This is also successful to eliminate wasteful heat generation and to save power.

In the fixing device 1 or the modification thereof, a number of resistors 14, for example, are selectively driven in matching relation to the shape of a toner image formed on a sheet. Alternatively, the present invention may be implemented as a fixing device which selectively drives heating portions in the widthwise direction of a sheet perpendicular to the direction of sheet feed. Then, when an image formed on a postcard or similar sheet of relatively small size is to be fixed, wasteful heat generation and, therefore, wasteful power consumption will be reduced.

In summary, it will be seen that the present invention provides a fixing device for an image forming apparatus having various unprecedented advantages, as enumerated below.

(1) A heating member has a number of heating portions which are selectively driven in matching relation to a toner image formed on a sheet. This prevents the heating member from generating heat wastefully and, therefore, contributes a great deal to power saving.

(2) A fixing belt is implemented as an anisotropic conductive film having high conductivity in the widthwise direction thereof and low conductivity in a direction perpendicular thereto. This promotes the conduction of heat to a sheet via the belt. This, coupled with the fact that heat radiation ascribable to heat conduction in the direction perpendicular to the widthwise direction is small, insures an extremely high thermal efficiency, further reducing power consumption.

(3) The heating portions are divided in a direction perpendicular to an intended direction of sheet transport. This allows, e.g., only the heating portions located above a toner image to be driven, thereby eliminating wasteful heat generation and reducing power consumption.

(4) The belt is constituted by a 5.0 microns to 50 microns thick anisotropic conductive film and, therefore, achieves high durability and high flexibility and thermal conductivity at the same time.

(5) The heating portions are arranged in a plurality of arrays perpendicular to the intended direction of sheet transport and different in the positions of heating portions from each other. This allows the divided heating portions to heat the entire surface of a sheet and, therefore, eliminates defective fixation.

Various modifications will become possible for those skilled in the art after receiving the teachings of the present disclosure without departing from the scope thereof.

What is claimed is:

1. A fixing device comprising:

an endless fixing belt rotatably supported and constituted by a 5.0 microns to 50 microns thick anisotropic conductive film;

a sheet transport path including a periphery of said endless fixing belt for transporting a sheet therealong; and a heating member facing said sheet transport path via said endless fixing belt.

2. A device as claimed in claim 1, wherein said heating member comprises a number of separate heating portions arranged in a direction perpendicular to an intended direction of sheet transport.

3. A device as claimed in claim 2, further comprising heat control means for driving only part of said heating portions located above a toner image carried on said sheet.

4. A device as claimed in claim 2, further comprising heat control means for driving part of said heating portions located above a toner image carried on said sheet and part of said heating portions surrounding said toner image.

5. A device as claimed in claim 2, further comprising heat control means for selectively driving said heating portions on the basis of a width of said sheet perpendicular to the intended direction of sheet transport.

6. A device as claimed in claim 2, wherein said heating member further comprises a plurality of separate heating portion arrays arranged in the intended direction of sheet transport and in different positions, from said heating portions in a direction perpendicular to said intended direction of sheet transport from each other.

7. A fixing device comprising:

an endless fixing belt rotatably supported and constituted by an anisotropic conductive film comprising a plurality of conductive pins formed in a thickness direction therein;

a sheet transport path including a periphery of said endless fixing belt for transporting a sheet therealong; and a heating member facing said sheet transport path via said endless fixing belt.

8. A device as claimed in claim 7, wherein said fixing belt is constituted by a 5.0 microns to 50 microns thick anisotropic conductive film.

9. A device as claimed in claim 7, wherein said conductive pins are formed of nickel.

10. A device as claimed in claim 7, wherein said heating member comprises a number of separate heating portions arranged in a direction perpendicular to an intended direction of sheet transport.

11. A device as claimed in claim 10, further comprising heat control means for driving only part of said heating portions located above a toner image carried on said sheet.

12. A device as claimed in claim 10, further comprising heat control means for driving part of said heating portions located above a toner image carried on said sheet and part of said heating portions surrounding said toner image.

13. A device as claimed in claim 10, further comprising heat control means for selectively driving said heating portions on the basis of a width of said sheet perpendicular to the intended direction of sheet transport.

14. A device as claimed in claim 10, wherein said heating member further comprises a plurality of separate heating portion arrays arranged in an intended direction of sheet transport and in different positions from said heating portions in a direction perpendicular to said intended direction of sheet transport from each other.

* * * * *